US006732891B2

(12) United States Patent
Locklear, III

(10) Patent No.: US 6,732,891 B2
(45) Date of Patent: May 11, 2004

(54) SECURE, QUICK-RELEASE HANDGUN HOLSTER

(76) Inventor: Burney Locklear, III, 4747 N. Old Georgetown Rd., Coward, SC (US) 29530

( * ) Notice: Subject to any disclaimer, the term of this patent is extended or adjusted under 35 U.S.C. 154(b) by 185 days.

(21) Appl. No.: 09/943,335

(22) Filed: Aug. 30, 2001

(65) Prior Publication Data

US 2003/0042279 A1 Mar. 6, 2003

(51) Int. Cl.[7] ..... F41C 33/02
(52) U.S. Cl. ..... 224/244; 224/911
(58) Field of Search ..... 224/198, 196, 224/243, 244, 245, 911

(56) References Cited

U.S. PATENT DOCUMENTS

| | | | | | |
|---|---|---|---|---|---|
| 1,635,984 | A | * | 7/1927 | Corriston | 224/244 |
| 1,750,139 | A | * | 3/1930 | Swift | 224/244 |
| 2,349,376 | A | * | 5/1944 | Ray | 224/244 |
| 2,551,913 | A | * | 5/1951 | Toby | 224/244 |
| 3,718,240 | A | | 2/1973 | Rose | |
| 3,865,289 | A | | 2/1975 | Boren | |
| 3,904,091 | A | | 9/1975 | Jones | |
| 3,910,469 | A | * | 10/1975 | Baldocchi | 224/244 |
| 4,256,243 | A | | 3/1981 | Bianchi et al. | |
| 4,342,410 | A | | 8/1982 | Sloan | |
| 4,463,884 | A | | 8/1984 | Parlante | |
| 4,925,075 | A | | 5/1990 | Rogers | |
| 4,934,574 | A | | 6/1990 | Salandre | |
| 5,275,317 | A | * | 1/1994 | Rogers et al. | 224/244 |
| 5,284,281 | A | | 2/1994 | Nichols | |
| 5,395,021 | A | | 3/1995 | Brown | |
| 5,419,474 | A | | 5/1995 | Marx et al. | |
| 5,518,155 | A | * | 5/1996 | Gallagher | 224/244 |
| 5,573,157 | A | | 11/1996 | Mauriello et al. | |
| 5,918,784 | A | | 7/1999 | Serpa | |
| 5,944,239 | A | | 8/1999 | Rogers et al. | |

* cited by examiner

*Primary Examiner*—Nathan J. Newhouse
(74) *Attorney, Agent, or Firm*—Kathleen M. Harleston; Harleston Law Firm LLC

(57) ABSTRACT

A safe, quick-drawing holster includes: (a) a frame support (23) with an open top, the frame support comprising a bottom end (22) and at least one side panel (15); (b) a retention assembly (30) including a retention bracket (31), a retention plate (34) adjacent to a side of the retention bracket, and a trigger-impinging means (37) projecting from a side of the retention plate (34) into the retention bracket (31); (c) a spring-loaded actuator assembly (29) including an actuator (40) connected to an actuator arm (42), a portion of the actuator (40) extending through the side panel (15) to the outside, a portion of the actuator arm (42) extending inwardly through the side panel 15 into the retention bracket (31) and to the retention plate (34); and (d) a stabilizer spring assembly (79) including a stabilizer pin (81) having a base affixed to panel of the holster, and a movable power spring (80) substantially surrounding the stabilizer pin. A method of using the holster is also included herein.

23 Claims, 7 Drawing Sheets

SECURE, QUICK-RELEASE HANDGUN HOLSTER

BACKGROUND OF THE INVENTION

1. Technical Field

The present device is a gun holster with a stabilizer spring assembly and actuator assembly that allow for quick release of the gun, and a safety assembly and retention assembly for keeping the gun securely in the holster when it is not in use.

2. Background Information

Many policemen and security guards across our nation are killed each year by their own guns. Criminals occasionally take an officer's gun right out of his holster, or wrest the officer's handgun from his hands, and shoot the officer or a bystander. In order to protect officers and guards from such people, there is a need for a gun holster that prohibits access by all but its wearer, yet allows a quick draw.

Unfortunately, safety and quick-release appear to be mutually exclusive terms. When safety is improved by making a more complex safety on the gun, draw time is oftentimes increased. In order to protect officers and other innocent victims, both qualities are needed. Officers' holsters must be safe, and their draw must be fast so that they can protect themselves and others from threats.

The present invention is a secure, quick-release gun holster. With the present invention, the officer has ready access to his gun, if he should require it in the course of his duties. At the same time, the present invention prevents an attacker from grabbing the officer's weapon from his or her holster and using it on the officer or others. This invention also acts to prevent accidental withdrawal of the gun from the holster.

The solution is made more complicated by the many different types of handguns that can be used in a holster. For example, a Glock is a bulky, polymer frame gun with a wide trigger guard, while a Baretta is designed for military use by a soldier with a gloved hand. It has a long trigger guard. A holster that can function well with different types of handguns, like the present invention, is more versatile and useful.

The holster of the present invention is safe, lightweight, and quick-release. It generally includes an open front to allow easy removal of the gun, a bottom loading spring providing quick release of the gun, a retention assembly by means of which the gun is retained in the holster when desired, a hand-operated actuator assembly by means of which the gun is released from the retention assembly, and a safety that will not accidentally release. Most embodiments are also adaptable for the future, consistent performers, and provide feedback to the user.

BRIEF SUMMARY OF THE INVENTION

The present invention is a quick-drawing holster for retaining a handgun having a trigger and trigger guard, the holster comprising:

(a) a frame support with an open top, the frame support comprising a bottom end and at least one side panel;

(b) a retention assembly comprising a retention bracket, a retention plate adjacent to a side of the retention bracket, and a trigger-impinging means projecting from a side of the retention plate into the retention bracket;

(c) a spring-loaded actuator assembly comprising an actuator connected to an actuator arm, at least a portion of the actuator extending through the side panel to the outside, at least a portion of the actuator arm extending inwardly through the side panel into the retention bracket and to the retention plate; and (d) a stabilizer spring assembly comprising a stabilizer pin having a base affixed to panel of the holster, and a movable power spring substantially surrounding the stabilizer pin. The holster preferably also includes (e) a safety assembly, which comprises a safety button or switch affixed to a rear panel of the holster.

Also included herein is a method of using a gun holster, comprising the steps of:

(a) moving a safety button into an "on" position, which moves a safety lock arm connected to the safety button into an up position, which moves a safety lock arm hook connected to the safety lock arm away from an actuator arm, the actuator arm being attached to an actuator, so that the actuator is depressible; and (b) depressing the actuator, which causes the actuator arm to move toward a retention assembly at an end portion of the actuator arm, the retention assembly comprising a retention bracket adjacent to a retention plate, a retention wedge and retention pin projecting from a same side of the retention plate through holes in the retention bracket, the end of the actuator arm pushing the retention plate away from the retention bracket, thus disengaging the retention wedge and retention pin from the retention bracket, and therefore from a trigger and trigger guard of a handgun restrained in the holster, so that the handgun may be drawn from the holster; and preferably further including the steps of:

(c) releasing the actuator, causing tension in an actuator spring around the actuator arm to push the actuator arm back to an initial position, causing the actuator arm to pull the retention plate back to its previous position; and (d) replacing the handgun in the holster, thus allowing the trigger guard to slide past the retention wedge, forcing the retention plate away from the retention bracket, disengaging the retention plate until the trigger guard has slipped past the retention wedge, allowing the retention plate to return by force of the actuator spring to a secure position, whereby the trigger guard is again positioned between the retention wedge and retention pin, thus restraining the handgun in the holster.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
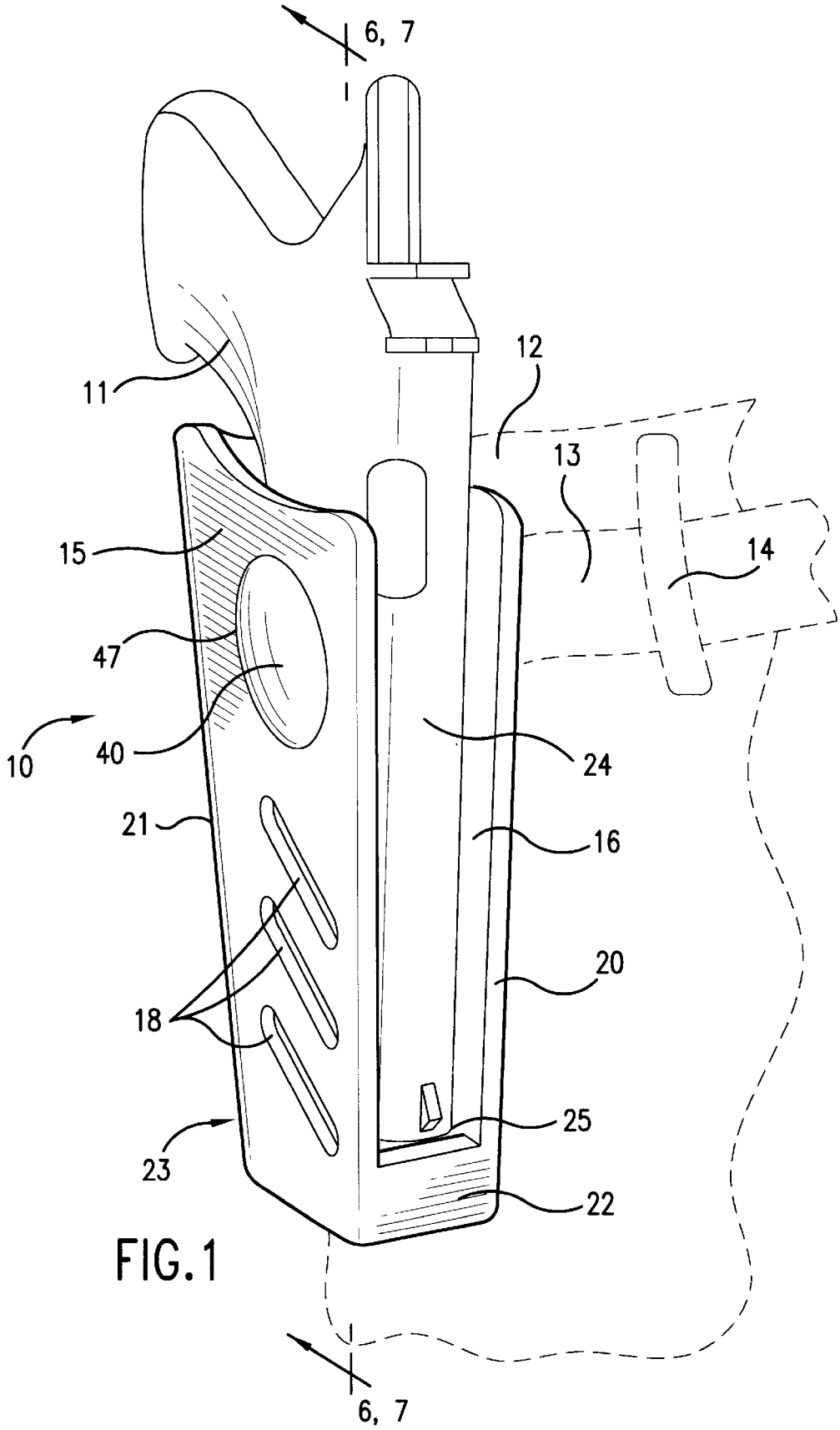
FIG. 1 is a perspective view of a gun holster according to the present invention, showing a pistol positioned therein.
Figure 4:
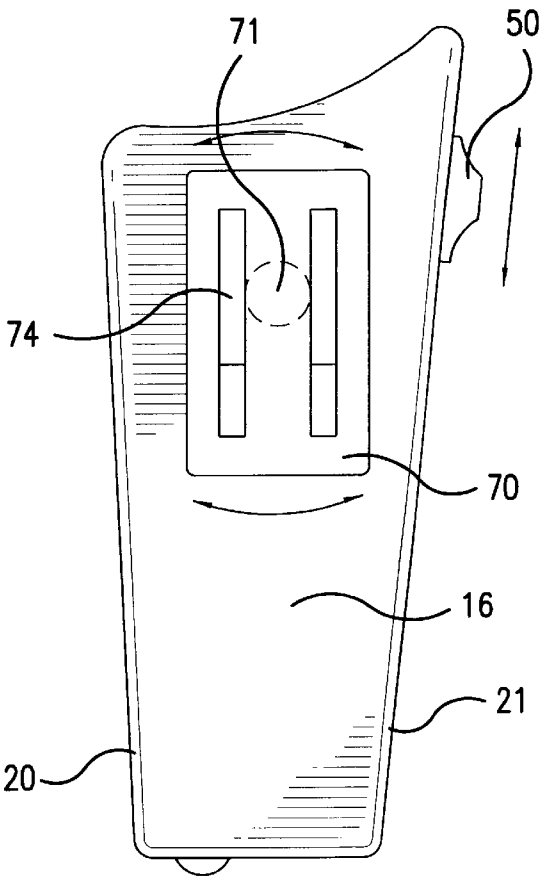
FIG. 4 is a left side elevational view of the holster of FIG. 2.

In the following description, like reference characters designate like or corresponding parts throughout the several views. Also, in the following description, it is to be understood that such terms as "front," "back," and the like are words of convenience and are not to be construed as limiting terms. Referring in more detail to the drawings, the invention will now be described.

With reference to FIG. 1, there is shown a holster, generally referred to as 10, for the containment of a pistol or handgun 11. In the preferred embodiment shown in FIG. 1, the holster 10 has an open front, which allows the gun 11 when drawn to be pulled outward and forward in one motion, instead of having to be pulled upward and out of the holster 10 before being pulled forward.

Pants 12 and a belt 13 are shown in dashed outline in FIG. 1 to show that the holster 10 can be mounted on a belt loop 14. The holster 10 can alternatively be mounted on the strap of a side holster, a shoulder holster, or a leg holster. It is mountable in a police cruiser or other vehicle.

Figure 3:
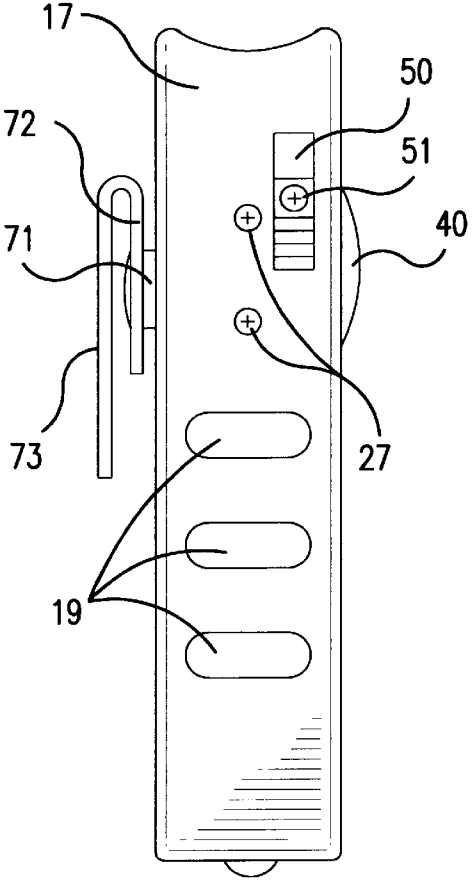
FIG. 3 is a rear elevational view of the holster of FIG. 2.

Referring to FIG. 1, FIG. 2, FIG. 3, and FIG. 4, the holster 10 is generally constructed of several portions or panels 15, 16, 17, joined to one another in an angular fashion. In the preferred embodiment shown in FIG. 1 and FIG. 2, the right, or outer, side panel 15 of the holster 10 contains side ports 18, preferably three parallel, diagonally oriented slots, which are angled downward from the rear towards the front. As shown in FIG. 3, the rear panel 17 also contains (rear) ports 19, these being parallel, horizontally oriented slots. The ports 18, 19 allow ventilation, improve aesthetics, and reduce the weight of the holster 10. The holster of the present invention is lightweight, which is particularly advantageous to a policeman or security guard, who may have to pursue a suspect on-foot, and who has to also carry various other necessary equipment. The invention could also be constructed of other suitable configurations and materials with an open front; the angular panels 15, 16, 17 and ventilation ports 18, 19 in the preferred embodiment are not essential to the present invention.

Figure 2:
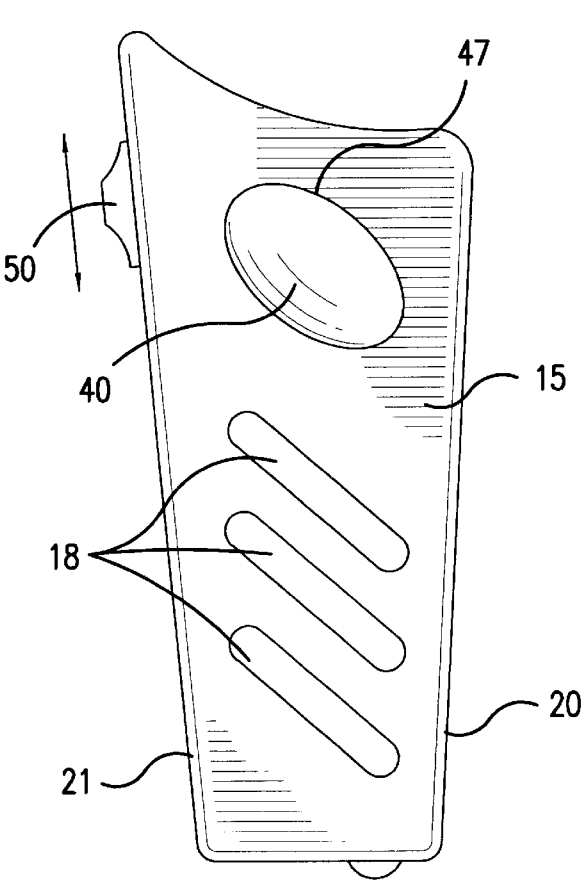
FIG. 2 is a right side elevational view of a holster according to the present invention.

Continuing with FIG. 1, FIG. 2, FIG. 3, and FIG. 4, the opposite long sides 20, 21 of the rear panel 17 are connected, preferably at right angles, to the corresponding long rear sides of the right and left side panels 15, 16. Although the rear panel 17 is generally rectangular in shape, the generally quadrilateral side panels 15, 16 are preferably slightly wider at the top than the bottom, as shown in FIG. 2 (right, outer panel 15) and FIG. 4 (left, inner panel 16). The rear long sides 20 of the right and left side panels 15, 16 are longer than the front long sides 21 of the side panels 15, 16, as is apparent in FIG. 2 and FIG. 4. As seen in the preferred embodiment of FIGS. 2 through 4, the upper ends of each of the three panels 15, 16, 17 are curved so as to cradle a handgun. The holster 10 also comprises a bottom panel 22 to support the handgun. The bottom panel 22 connects at right angles to, or fits between, the lower ends of the three panels 15–17. The panels make up a frame support 23, which is comprised of the rear panel 17, outer side panel 15, inner side panel 16, and bottom panel 22, but not a panel on top of the holster 10, ad preferably not a panel in front of the holster 10/gun barrel 24.

Preferably, though, the panels 15–17, 22 are portions of a one-piece, injection molded, polymer holster. Any suitable materials, such as leather, plastic, and/or aluminum, can be used to make the holster. The edges of the molded holster 10 are preferably rounded so as not to scratch the gun in it. The gun 11 is placed into the holster 10 in an inverted position, with the muzzle 25 of the gun pointed downward.

Figure 5:
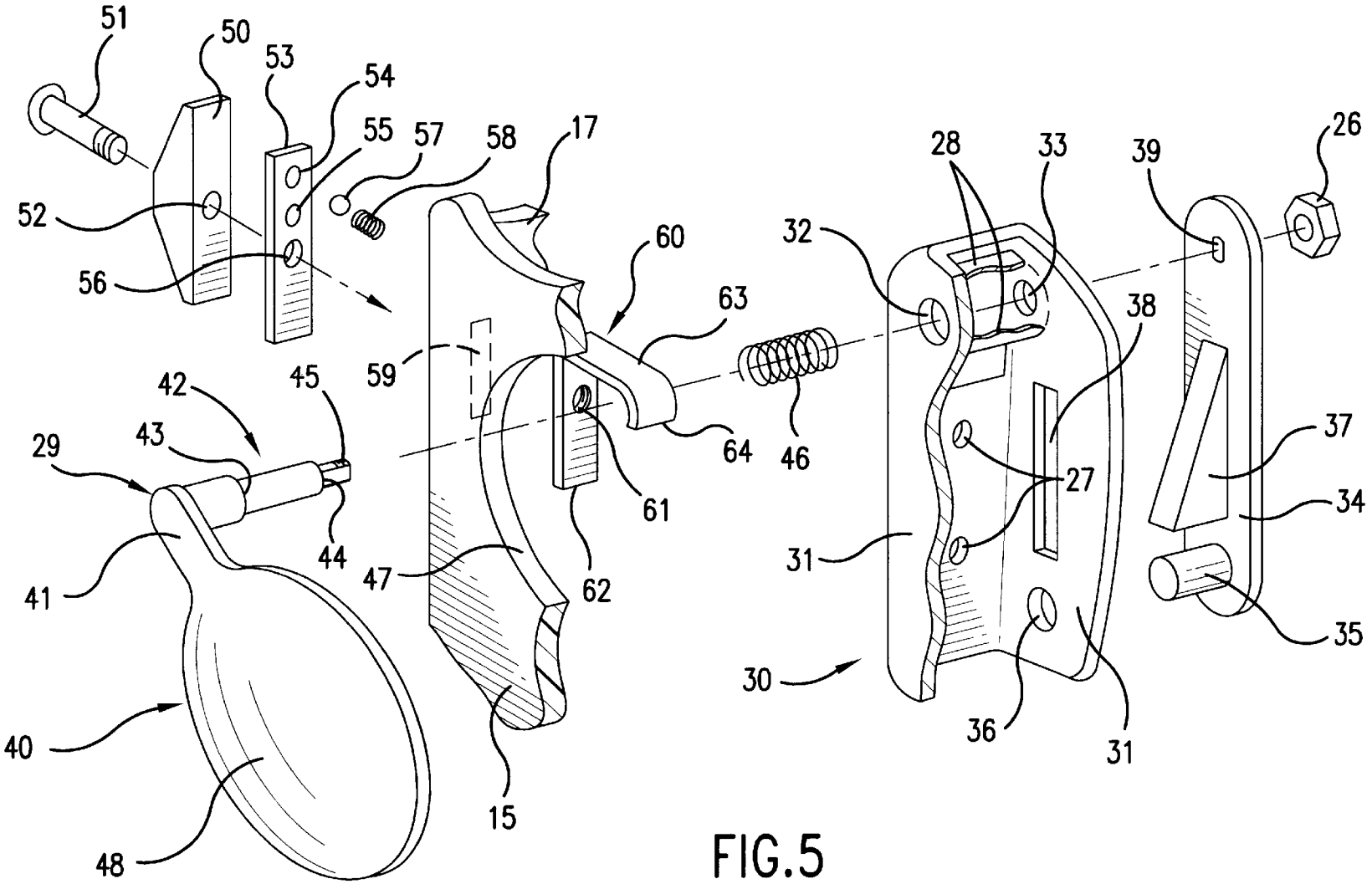
FIG. 5 is an exploded, perspective view of an actuator assembly and a cutaway of a retention assembly of a holster according to the present invention.

Turning to FIG. 5, which is an exploded view, the holster 10 preferably includes a retention assembly 30 for holding the gun 11 securely in the holster 10 until it is released by the user. This is particularly important for the preferred embodiment, since it has an open front. The holster 10 is comprised of a frame support 23, an actuator assembly 29, a retention assembly 30, a safety assembly 49, and a stabilizer spring assembly 79. The safety assembly 49 and the retention assembly 30 keep the gun 11 secure in the holster 10 when it is not in use. The actuator assembly 29 and the stabilizer spring assembly 79 allow for quick release of the gun.

As shown in FIG. 5, the retention assembly 30 includes a bracket 31 secured to the rear panel 17 of the holster 10 on the inside by means of two rear retention assembly screws 27 projecting through holes in the retention bracket 31 (also see FIG. 3). Of course, alternative means of affixing the retention assembly to the panel are included herein. In this preferred embodiment, the bracket 31 and retention assembly 30 are positioned approximately two-thirds of the distance down from the top of the holster rear panel 17, so that the trigger 65 and trigger guard 66 (see FIG. 6) of the gun 11 will fit into the retention bracket 31 when the handgun is placed into the holster 10. A retention plate 34 is attached to the outside of the bracket 31 on the side corresponding to the inner, or belt, side 16 of the holster 10. The retention plate 34 is of a generally elliptical, elongated shape corresponding to the side of the bracket 31, with a wedge-shaped projection 37, and beneath it, a retention pin 35, both projecting at right angles to the flat side of the retention plate 34. The wedge 37 is positioned on the retention plate 34 with the base or wide edge toward the bottom, so that the wedge 37 slopes downward and the wedge 37 fits into a corresponding slot 38 in the side of the bracket 31. The retention pin 35 is likewise positioned on the retention plate 34 so that it fits into a hole 36 on the same side of the bracket 31.

The retention plate 34 is secured to the bracket 31 by means of the actuator arm 42, which fits through two holes 32, 33, one on each side of the bracket 31 near the top of the bracket 31, as shown in FIG. 5. The end 45 of the actuator arm 42 is threaded for attachment to a threaded nut 26. The actuator arm 42 exits the bracket 31 and its end 45 fits into a hole 39 on an upper portion of the retention plate 34. The threaded actuator arm end 45 is fastened on the other side of the retention plate 34 by the threaded nut 26.

Referring still to FIG. 5, when the handgun 11 is secured in position, the gun barrel 24 fits into the holster 10 such that the retention wedge 37 fits inside the trigger guard 66 and the retention pin 35 fits just outside the trigger guard 66. The result is that the retention wedge 37 and retention pin 35 are on either side of the trigger guard 66, thus holding the gun 11 in place and preventing accidental firing. In this embodiment, the front of the trigger guard fits between the retention wedge 37 and the front pin 35. Although the wedge 37 simplifies reholstering the weapon 11, the holster 10 could easily be made without a wedge.

Continuing with FIG. 5, the actuator arm 42 is attached to the holster 10 on the outer side 15 opposite the retention assembly 30 at right angles to an actuator assembly 29, by means of which the retention assembly 30 is disengaged and the gun 11 is released. The actuator assembly 29 comprises an actuator 40, which is a generally spoon-shaped appendage to an actuator arm 42, with the handle 41 of the spoon shape being short in comparison to the "bowl" 48 of the spoon-shaped actuator. The actuator 40 is preferably constructed of rubber, plastic, or a similar, suitable, semi-rigid material. The concave side of the "bowl" 48 of the actuator 40 is preferably cushioned so that it does not scratch the portion of the sheathed gun 11 with which it comes in contact. Referring to FIG. 1, FIG. 2, and FIG. 5, the convex side of the actuator bowl 48 fits through an actuator port 47 in the right, or outer, side panel 15 of the holster 10. The actuator port 47 and the actuator 40 are diagonally oriented, angled downward from the rear towards the front, above and parallel to the three side ports 18 in the side panel 15. In the case of a side holster, for example, positioned on the user's right side, the actuator 40 is thus within easy reach of the heel of the user's right hand, so that the user depresses the actuator 40 with the hand, causing the actuator arm 42 to move toward the retention assembly 30.

Turning again to FIG. 5, the actuator arm 42 has two stepped shoulders 43, 44, and a threaded end 45, which fits into an actuator hole 39 in the retention plate 34 (mentioned above). When the user depresses the actuator 40, the end 45 of the actuator arm 42 pushes the retention plate 34 away from the retention bracket 31, thus disengaging the retention wedge 37 and retention pin 35 from the bracket 34 and from the trigger 65 and trigger guard 66 (see FIG. 6), so that the gun 11 may be drawn from the holster 10.

Figure 6:
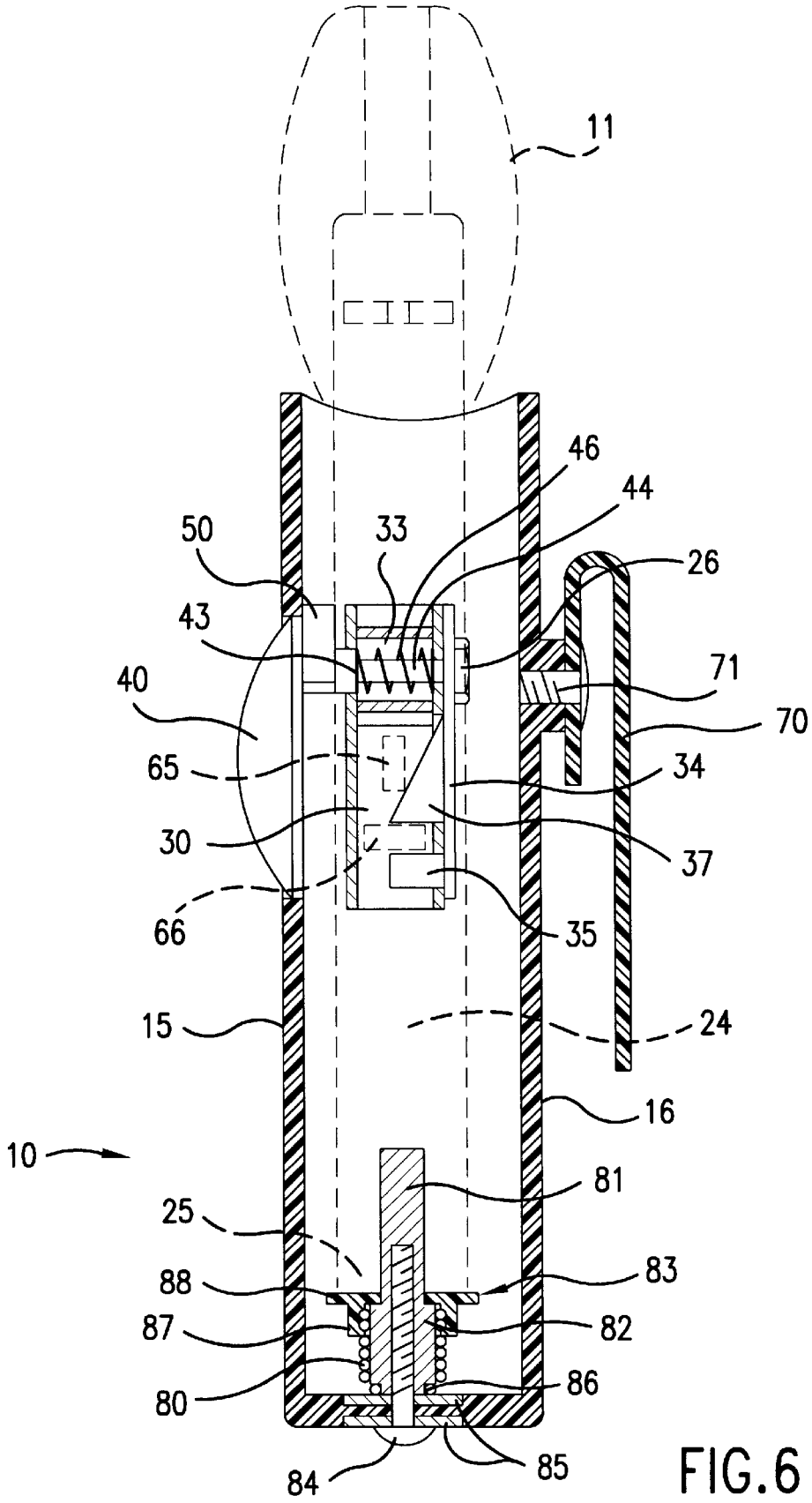
FIG. 6 is a front cross-sectional view of the holster shown in FIG. 1, taken along line 6—6 and showing the holster in a rest position.
Figure 7:
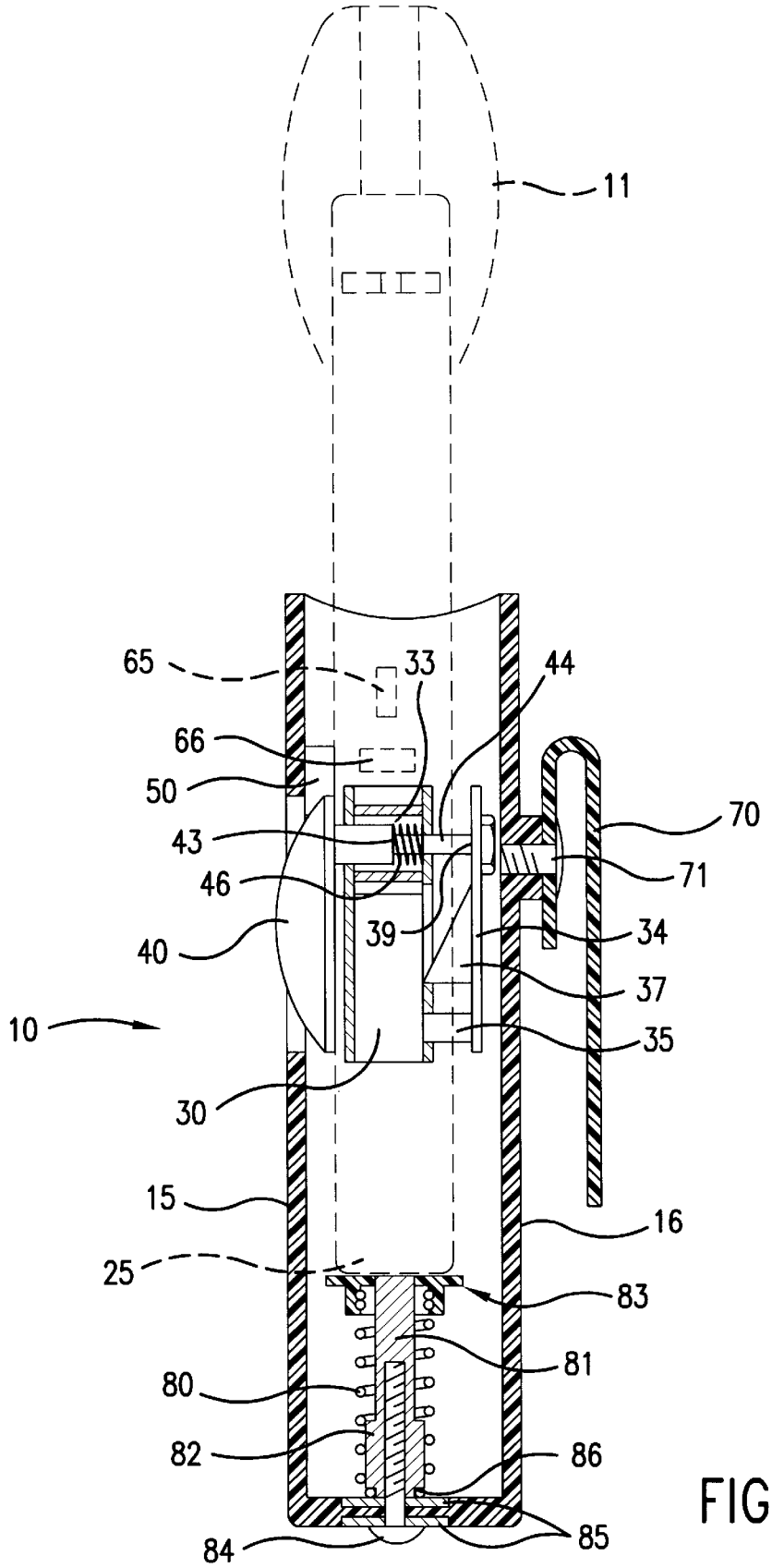
FIG. 7 is a front cross-sectional view of the holster shown in FIG. 1, taken along line 7—7 and showing the holster in an activated position.

Referring to FIG. 5, FIG. 6, and FIG. 7, the second stepped shoulder 44 of the actuator arm 42 fits through the two holes 32 (return spring hole), 33 (actuator arm hole) in the retention bracket 31, but not through the actuator hole 39 in the retention plate 34. This allows the actuator arm 42 to move through the retention bracket 31, but stop at the retention plate 34, thus pushing the retention plate 34 away from the bracket 31, without moving the retention bracket 31. A cylindrical actuator return spring 46 fits around the second shoulder 44 of the actuator arm 42, but not the first shoulder 43 of the actuator arm 42. The actuator arm hole 33 nearest the retention plate 34 is sized slightly smaller than the hole 32 (return spring hole) nearer the actuator 40, so that the return spring 46 will fit through the larger return spring hole 32, but not the smaller, actuator arm hole 33. Thus, when the actuator arm 42 is depressed, the first shoulder 43 of the actuator arm 42 will compress the return spring 46 against the side of the retention bracket 31. When the actuator 40 is released, the tension in the actuator return spring 46 will push the actuator arm 42 back to its previous position, and the actuator arm 40 will pull the retention plate 34 back to its previous position. Further, when the user replaces the gun 11 in the holster 10, the shape and position of the retention wedge 37 allow the trigger guard 66 to slide past the wedge 37, forcing the retention plate 34 away from the retention bracket 34, disengaging it until the trigger guard 66 has slipped past the wedge, allowing the retention plate 34 to return by force of the actuator return spring 46 to the secure position, whereby the trigger guard 66 is again positioned between the retention wedge 37 and retention pin 35, maintaining the gun 11 in the holster 10. A horizontally oriented, cylindrical retention assembly spring guard 28 is constructed into the retention bracket 31, enclosing the actuator return spring 46 to prevent it from being dislodged.

Turning again to FIG. 5, the holster 10 further comprises a safety assembly 49, which comprises a safety button 50. The safety button 50 is provided on the rear panel 17 to prevent accidental release of the gun 11 from the holster 10. The safety button 50 is connected to a safety lock arm 60. The safety lock arm 60 is a narrow flat rectangular member, bent at a right angle so that viewed along the narrow edge it is generally L-shaped. Along the flat side, the lower portion 62 is vertically oriented and attached flush to the rear panel 17 by means of a safety screw 51, which fastens into a threaded screw hole 61. At the bend in the lock arm 60, the upper portion 63 projects away from and perpendicular to the rear panel 17 over the actuator arm 42, ending in another short bend 64, or hook, perpendicular to the upper portion 63 and curving toward the lower portion 62. The safety button 50 is attached to the rear panel by means of the same safety screw 51, so that when the safety button is in the down or position, the safety lock arm 60 is also in the down position. Likewise, when the safety button 50 is in the up or off position, the safety lock arm 60 is also in the up position.

Referring to FIG. 6 and FIG. 7, when the safety button 50 is in the down, on position (see FIG. 6), the safety lock arm hook 64 will prevent the actuator arm 42 from moving toward the retention assembly 30 and will thus prevent the user from releasing the gun 11, even when the actuator 40 is depressed. When the safety button 50 is moved up to the off position (see FIG. 7), the safety lock arm 60 also moves up and away from the actuator arm 42. The safety lock arm hook 64 then no longer obstructs movement of the actuator arm 42 and the user may depress the actuator 40 and release the gun 11, as described above.

Turning again to FIG. 5, the device also includes a safety detent ball slide 53 and safety detent ball 57 and spring 58. The safety detent ball slide 53 is of a flat rectangular shape corresponding to the rear side of the safety button 50, and has a screw hole 56 aligning with the screw hole 52 in the safety button. The safety button screw hole 52 and safety slide screw hole 56 in turn align with the safety lock arm screw hole 61, so that the safety screw 51 passes through all three, and through a slot 59 in the rear panel 17. The safety slide 53 is indented with two detent ball slide sockets 54, 55, aligned vertically above the safety screw hole 56. The safety detent ball 57 is forced into either the upper socket 54, or the lower socket 55, by the tension in the safety detent spring 58, depending on the position of the safety button 50. When the safety button 50 is moved upward, the safety detent ball is pushed into the lower socket 55 and the safety is in the "off" position. The actuator 40 can then be used to release the gun 11, as described above. When the safety button 50 slides downward, the spring pushes the safety detent ball 57 into the upper socket 54, and the safety is in the "on" position. The movement of the safety detent ball 57 into the ball slide position socket 54, 55 creates an audible click, which alerts the user that the safety has been engaged or disengaged. In this way, the holster 10 provides audio feedback to the user.

Continuing with FIG. 6 and FIG. 7, a stabilizer spring assembly 79 comprises a power spring 80 and a stabilizer pin 81 at the bottom of the inside of the holster 10. The spring 80 is positioned loosely around the stabilizer pin 81, which is preferably stationary. A stabilizer pin screw 84 and stabilizer pin washers 85, which are preferably metal, hold the stabilizer pin 81 in place. Included herein are alternate means of holding the stabilizer pin 81 in place. The stabilizer pin 81 extends vertically upward parallel to and centered in the holster 10, and is of sufficient length to extend into the gun barrel 24 when holstered, which in turn helps to keep the gun 11 in place. A hex nut preferably holds the power spring 80 on the bottom panel of the holster 10.

As shown in FIG. 6 and FIG. 7, the stabilizer pin 81 is generally cylindrical and of varying widths. Around the bottom of the stabilizer pin 81 is a spring groove 86 at the point where the stabilizer pin 81 is narrowest. In approximately the middle, vertically speaking, the stabilizer pin 81 is stepped with a stabilizer pin shoulder 82, above which the pin 81 again becomes narrower. The end coil of the power spring 80 is tighter at its base and wraps around the pin 81, fitting into the spring groove 86, so that the power spring 80 is held in place by the stabilizer pin 81. The other (upper) end of the power spring 80 is coiled into a threaded cap 83 and around the stabilizer pin 81, which passes through the stabilizer spring cap 83 into the gun barrel 24. The cap 83 is of varying widths both inside and outside. The inside bore of the stabilizer spring cap 83 is wider at the lower end to match the shoulder 82 of the pin 81 and narrows so that the shoulder 82 of the stabilizer pin 81 creates a stopping point for the stabilizer spring cap 83 when it travels downward as the gun 11 is inserted into the holster 10. The stabilizer spring cap 83 widens just enough above the shoulder 82 of the pin 81 to allow passage of the rest of the pin 81. The lower segment 87 of the stabilizer spring cap 83 is wide enough on the outside to enclose the spring 80. The upper segment 88 of the stabilizer spring cap 83 is a disk wide enough to prevent the stabilizer spring cap 83 from passing into the gun barrel 24. Referring to FIG. 6, when the gun 11 is secured in the holster 10, the gun barrel 24 pushes the stabilizer spring cap 83 down until it stops against the shoulder 82 of the stabilizer pin 81 and compresses the power spring 80.

Referring to FIG. 5 and FIG. 7, when the actuator 40 is depressed, and the retention wedge 37 and retention pin 35 are disengaged, the power spring 80 is released and pushes the stabilizer spring cap 83 upward, forcing the gun 11 upward and out of the holster 10. The tension of the power spring 80 thus provides a power boost to the user and ensures a quick release of the gun 24. When they are engaged, the gun 11 is locked down by the retention plate 34 and the stabilizer pin 81; it is secured at the muzzle 25 and the trigger guard 66.

The preferred embodiment of this invention has several notable features, including the following. First, the pop-up feature of the stabilizer spring assembly 79 pops the gun 11 up in a vertical direction one to two inches out of the holster, as seen in FIG. 7, into the hand of the user. The user, who has his or her hand around the pistol grip, tips the gun barrel 24 forward so that the muzzle 25 is pointed at the target. In contrast, the sheathed gun 11 can be seen in outline form in FIG. 6. Secondly, the base of the stabilizer pin 81 is stepped so the gun barrel 24 does not go down too far. The spring 80 compresses to the height of the base. Thirdly, the actuator bowl 48 acts as a brake to slow the gun 11 down when it is being popped up by the power spring 80.

In the embodiment shown in FIG. 3, FIG. 4, FIG. 6, and FIG. 7, the holster 10 is equipped with an optional, pivotable belt clip 70. The belt clip 70 can be made in various configurations; in the embodiment shown, the belt clip 70 is in a curved, inverted "U" shape, with the arms 72, 73 being of unequal lengths. The shorter belt clip arm 72 is attached to a pivot post 71, which allows the belt clip 70 to rotate so that the user can adjust the holster 10 to the most comfortable position. The user slips the longer belt clip arm 73 over the belt.

Advantages of the present invention include one or more of the following:

1) Fast draw—The gun essentially draws itself through its retention. All the user has to do is move the gun forward; the user need not pull upwardly. The holster does not offer resistance when the gun is being drawn. The draw is faster because of the power spring 80 in the stabilizer spring assembly.
2) Safety—Until the gun is drawn, it is retained safely and securely in the holster. The user need not worry about losing his weapon by accident or through the act of an aggressor.
3) Lightweight and Durable—The frame support is made of a lightweight, durable material and selected parts are preferably made of plastic. It is comfortable to carry during long shifts on the job. It is preferably mass produced by an injection molding process.
4) Modern—This is a unique, modern-looking holster that addresses today's concerns. It is not a make-shift adaptation for an existing holster. For example, this holster 10 provides audio feedback to the user when the safety detent ball 57 clicks into the ball slide position socket 54, 55, thus alerting the user that the safety has been engaged or disengaged. It can be economically produced and fits a variety of handgun types.
5) Futuristic—This holster is also adaptable for the future. Guns of the future will likely have electronic sights, which will fit better in open-front holsters like the present one. Also, the safety assembly of the present invention can be adapted for current and emerging fingerprint technologies.
6) Simple and Reliable—This holster consistently performs well and is therefore reliable. It is simple and easy to operate with one hand.

There are two basic models of the present invention, depending on the location of the safety. In the competition model, which can look like the embodiment shown in FIGS. 1–7, the safety button 50 is on the outside back of the holster 10 for increased speed. With the safety in this position, the competitor can easily reach and manipulate it, which makes it more likely that he or she will place well in the competition. Also, the open front makes for a fast draw. The spring weights can be varied, and the retention plate 34 can be made shorter or longer to customize speed for the particular user, since different competitors have different talents and requirements.

Figure 8:
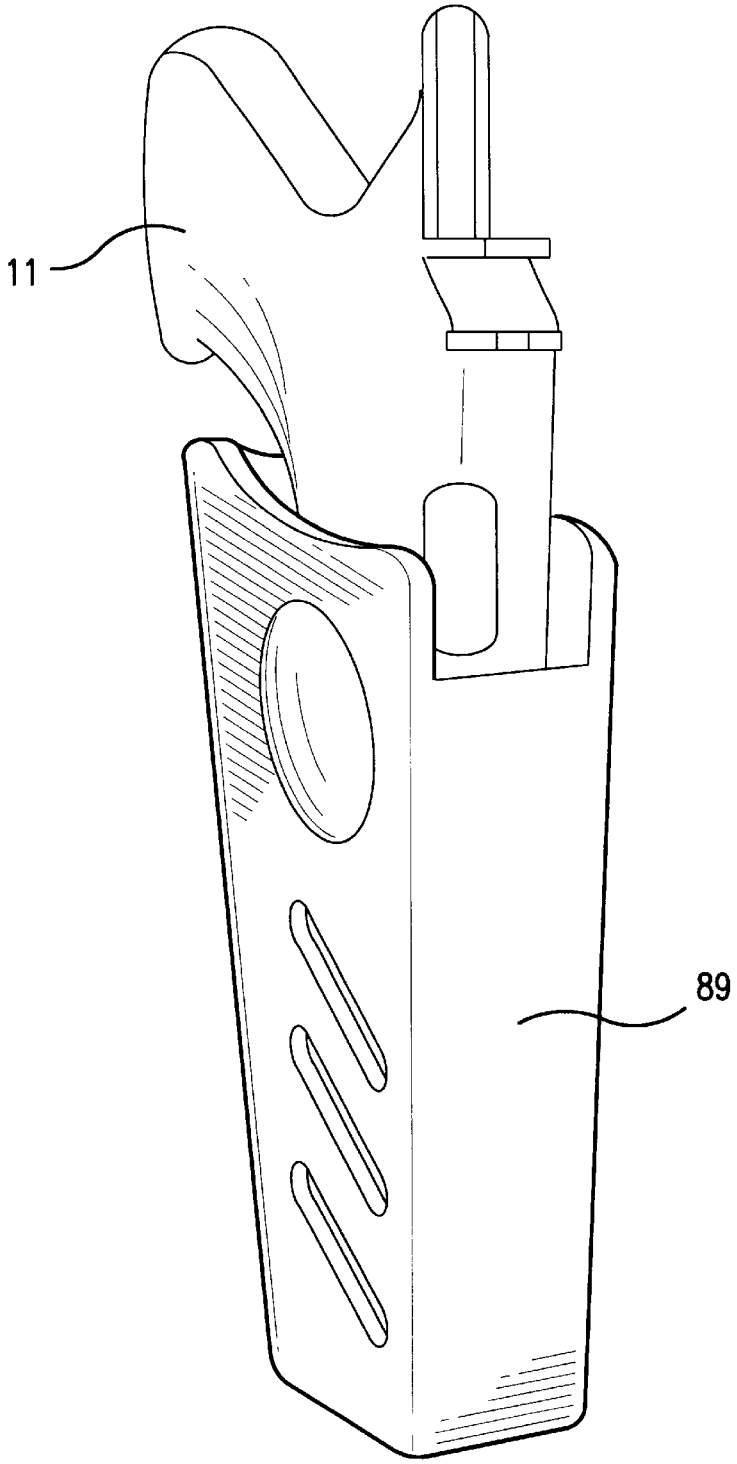
FIG. 8 is a perspective view of a second embodiment of a gun holster according to the present invention, showing a pistol positioned therein.
Figure 9:
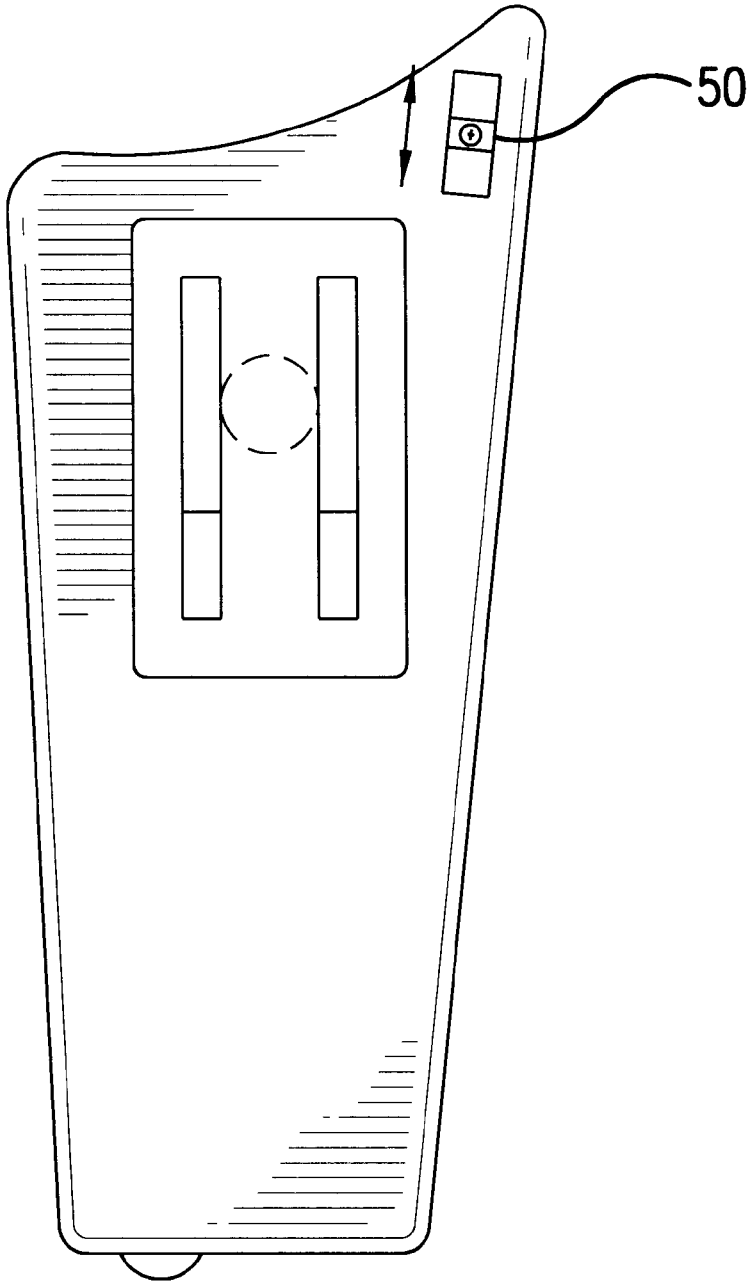
FIG. 9 is a left side elevational view of the holster of FIG. 8.

In the police model, which is shown in FIG. 8, the safety button 50 is discretely located inside the holster 10. The safety button 50 is moved forward and rearward by the officer's thumb (two steps). Only police holsters should have this hidden safety, so the public does not know how to release it. If the position of the safety were widely known, officer's guns would be more likely to be taken by aggressors. This holster model could also be used by special military units, such as United Nations troops keeping the peace in foreign countries.

The spring weight can be varied where the handgun has a delayed blowback action system. In a delayed blowback action, the gun barrel 24 and slide will give when pressure is applied to the end of the barrel 24. In contrast, the other common type of action on handguns is a blowback system, which includes a fixed barrel. For handguns with delayed blowback actions, it is believed that the resistance of the power spring 80 in the holster 10 should be less than or equal to the resistance of the recoil spring in the gun 11. In the present invention, the power spring weight can be varied according to the type of weapon intended for use in the holster. For each gun model, power springs of varying resistance should be experimented with to find the ideal spring weight for that model. For a handgun with a blowback action, though, varying the power spring weights would not be as useful, since the barrel 24 is fixed.

In the second embodiment shown in FIG. 8, the frame support 23 does include a front panel 89, which is affixed at its long side edges to the side panels 15 16 and along its bottom edge to the bottom panel 22. Alternatively, the front panel 89 is one portion of a one-piece frame support 23. More traditional users might prefer such a front on their holsters. Although some user lift is necessary when drawing a weapon from this embodiment, minimal effort is needed to draw the weapon because the pop-up feature (stabilizer spring assembly) lifts the gun up vertically a few inches out of the holster.

The holster may also comprise a removable debris guard (not shown) for protecting the retention assembly and actuator arm from dirt, small rocks, and other debris. Such debris can be a problem, for example, to a soldier exposed to harsh environmental conditions (e.g., crawling through a field). A preferred embodiment of the debris guard is almost a mirror image of the retention bracket, except that it has opposite flared lips extending from the top of the retention bracket to the bottom of the bracket when the guard is in use. The debris guard is most preferably a replaceable plastic sleeve that is inserted in the retention bracket.

The present invention further comprises a method of using the above-described holster, comprising the steps of:

(a) moving a safety button into an "on" position, which moves a safety lock arm 60 connected to the safety button into an up position, which moves a safety lock arm hook 64 connected to the safety lock arm away from an actuator arm 42, the actuator arm being attached to an actuator 40, so that the actuator 40 is depressible; and (b) depressing the actuator 40, which causes the actuator arm 42 to move toward a retention assembly 30 at an end portion of the actuator arm, the retention assembly 30 comprising a retention bracket 31 adjacent to a retention plate 34, a retention wedge 37 and retention pin 35 projecting from a same side of the retention plate through holes 36, 38 in the retention bracket, the end 45 of the actuator arm 42 pushing the retention plate 34 away from the retention bracket 31, thus disengaging the retention wedge 37 and retention pin 35 from the retention bracket, and therefore from a trigger 65 and trigger guard 66 of a handgun 11 restrained in the holster 10, so that the handgun 11 may be drawn from the holster 10. The first shoulder 43 of the actuator arm 42 compresses the return spring 46 against the side of the retention bracket 31.

Preferably, the method further comprises the steps of:

(c) releasing the actuator 40, causing tension in an actuator spring 46 around the actuator arm 42 to push the actuator arm 42 back to an initial position, causing the actuator arm 42 to pull the retention plate 34 back to its previous position; and (d) replacing the handgun 11 in the holster 10, thus allowing the trigger guard 66 to slide past the retention wedge 37, forcing the retention plate 34 away from the retention bracket 31, disengaging the retention plate until the trigger guard 66 has slipped past the retention wedge 37, allowing the retention plate 34 to return by force of the actuator spring 46 to a secure position, whereby the trigger guard 66 is again positioned between the retention wedge 37 and retention pin 35, thus restraining the handgun 11 in the holster 10.

In a preferred embodiment:

1) in step (d), when the gun 11 is secured in the holster 10, the gun barrel 24 pushes the stabilizer spring cap 83 down until it stops against the shoulder 82 of the stabilizer pin 81 and compresses the power spring 80.

2) when the actuator 40 is depressed, and the retention wedge 37 and the retention pin 35 are disengaged, the power spring 80 is released and pushes the stabilizer spring cap 83 upward, forcing the gun 11 upward and out of the holster 10.

3) when the retention wedge 37 and the retention pin 35 are engaged, the gun 11 is locked down by the retention plate 34 and the stabilizer pin 81; it is secured at the muzzle 25 and the trigger guard 66.

4) in step (a), when the safety button 50 is moved upward, a safety detent ball 57 is pushed into a lower, "on" ball slide position socket 54, which creates an audible click to alert the user that the safety has been disengaged.

5) when the safety button 50 is in the down position, the safety lock arm hook 64 will prevent the actuator arm 42 from moving toward the retention assembly 30 and will thus prevent the user from releasing the gun 11.

6) in step (a), when the safety button 50 is moved downward, a safety detent ball 57 is pushed into an upper, "off" ball slide position socket 55, which creates an audible click to alert the user that the safety has been engaged.

From the foregoing it can be realized that the described device of the present invention may be easily and conveniently utilized as a means for quickly releasing and drawing a gun from a holster while securing the gun in the holster and avoiding accidental release. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 Gun holster
11 Handgun
12 Pants
13 Belt
14 Belt loop
15 Outer side panel of holster
16 Inner side panel of holster
17 Rear panel of holster
18 Side ports
19 Rear ports
20 Rear long sides of side panels
21 Front long sides of side panels
22 Bottom panel

23 Frame support
24 Gun barrel
25 Muzzle
26 Actuator nut
27 Rear retention assembly screws/holes
28 Retention assembly spring guard
29 Actuator assembly
30 Retention assembly
31 Retention bracket
32 Retention bracket/return spring hole
33 Retention bracket/actuator arm hole
34 Retention plate
35 Retention pin
36 Retention pin hole
37 Retention wedge
38 Retention wedge slot
39 Retention plate/actuator hole
40 Actuator
41 Actuator handle
42 Actuator arm
43 Actuator arm outer shoulder
44 Actuator arm inner shoulder
45 End of actuator arm
46 Actuator spring
47 Actuator port
48 Actuator bowl
49 Safety assembly
50 Safety button
51 Safety screw
52 Safety button screw hole
53 Safety detent ball slide
54 Safety detent ball slide "on"-position socket
55 Safety detent ball slide "off"-position socket
56 Safety detent ball slide screw hole
57 Safety detent ball
58 Safety detent spring
59 Safety detent ball slide slot
60 Safety lock arm
61 Safety lock arm screw hole
62 Lower portion of safety lock arm
63 Upper portion of safety lock arm
64 Safety lock arm hook
65 Trigger
66 Trigger guard
70 Belt clip
71 Belt clip pivot
72 Belt clip short arm
73 Belt clip long arm
74 Belt slot
79 Stabilizer spring assembly
80 Power spring
81 Stabilizer pin
82 Stabilizer pin shoulder
83 Stabilizer spring cap
84 Stabilizer pin screw
85 Stabilizer pin washers
86 Spring groove
87 Spring cap lower segment
88 Spring cap upper segment
89 Front panel

What is claimed is:

1. A quick-drawing holster for retaining a handgun having a trigger and trigger guard, the holster comprising:

(a) a frame support with an open top, the frame support comprising a bottom panel and at least one side panel;

(b) a retention assembly comprising a retention bracket, a retention plate adjacent to a side of the retention bracket, and a trigger-impinging means projecting from a side of the retention plate into the retention bracket;

(c) a spring-loaded actuator assembly comprising an actuator connected to an actuator arm, at least a portion of the actuator extending through the side panel to the outside, at least a portion of the actuator arm extending inwardly through the side panel into the retention bracket and to the retention plate; and (d) a stabilizer spring assembly comprising a stationary stabilizer pin having a base affixed to a panel of the holster, and a movable power spring substantially surrounding the stabilizer pin.

2. A holster for retaining a handgun having a trigger and trigger guard, the holster comprising:

(a) a frame support with an open top, the frame support comprising a bottom panel, a rear panel, and at least one side panel;

(b) a retention assembly comprising a retention bracket, a retention plate adjacent to a side of the retention bracket, and a trigger-impinging means projecting from a side of the retention plate into the retention bracket;

(c) a spring-loaded actuator assembly comprising an actuator connected to an actuator arm, at least a portion of the actuator extending through the side panel to the outside, at least a portion of the actuator arm extending inwardly through the side panel into the retention bracket and to the retention plate;

(d) a stabilizer spring assembly comprising a stabilizer pin having a base affixed to a panel of the holster, and a movable power spring substantially surrounding the stabilizer pin; and a safety assembly, which comprises a safety button or switch affixed to the rear panel.

3. A holster according to claim 2, wherein the trigger impinging means is a retention pin, which projects from a side of the retention plate through a similarly sized retention pin hole in an adjacent side wall of the retention bracket.

4. A holster according to claim 3, wherein the retention assembly further comprises a wedge, which projects from one side of the retention plate through a similarly sized wedge slot in an adjacent side wall of the retention bracket.

5. A holster according to claim 2, wherein the stabilizer spring assembly further comprises a spring cap supported on the power spring and over the stabilizer pin.

6. A holster according to claim 2, comprising, two of the at least one side panels, one of which is an outer side panel, the other of which is an inner side panel, but no front panel.

7. A holster according to claim 6, wherein the safety button or switch is affixed to an outside of the rear panel.

8. A holster according to claim 6, wherein the actuator assembly further comprises an actuator spring, which extends loosely around at least a portion of the actuator arm.

9. A holster according to claim 6, further comprising a safety detent ball slide of a flat, rectangular shape corresponding to a rear side of the safety button, and having a screw hole aligning with the screw hole in the safety button, which, in turn, align with the safety lock arm screw hole, so that the safety screw passes through all three, and through a slot in the rear panel.

10. A holster according to claim 6, wherein the holster further comprises a pivotable belt clip fastened to the outside of the inner side panel.

11. A holster according to claim 9, wherein the safety slide is indented with two detent ball slide sockets aligned vertically above the safety screw hole, a safety detent ball being forced into either the upper socket, or the lower socket by tension in a safety detent spring, depending on the position of the safety button.

12. A holster according to claim 2, further comprising a stabilizer pin screw and stabilizer pin washers that hold the stabilizer pin in place; the stabilizer pin extending vertically upward and being centered on the bottom panel of the holster.

13. A holster according to claim 2, wherein a spring groove surrounds the base of the stabilizer pin, the stabilizer pin being stepped with a stabilizer pin shoulder.

14. A holster according to claim 8, the actuator arm movably extending through the actuator port in the outer side wall, through apertures in opposite side walls of the retention bracket at opposite ends of the retention assembly spring guard, and through a third, smaller aperture in an upper portion of the retention plate.

15. A method of using a gun holster, comprising the steps of:

(a) moving a safety button into an on position, which moves a safety lock arm connected to the safety button into an up position, which moves a safety lock arm hook connected to the safety lock arm away from an actuator arm, the actuator arm being attached to an actuator, so that the actuator is depressible; and (b) depressing the actuator, which causes the actuator arm to move toward a retention assembly at an end portion of the actuator arm, the retention assembly comprising a retention bracket adjacent to a retention plate, a retention wedge and retention pin projecting from a same side of the retention plate through holes in the retention bracket, the end of the actuator arm pushing the retention plate away from the retention bracket, thus disengaging the retention wedge and retention pin from the retention bracket, and therefore from a trigger and trigger guard of a handgun restrained in the holster, so that the handgun may be drawn from the holster.

16. A method according to claim 15, further comprising the steps of:

(c) releasing the actuator, causing tension in an actuator spring around the actuator arm to push the actuator arm back to an initial position, causing the actuator arm to pull the retention plate back to its previous position; and (d) replacing the handgun in the holster, thus allowing the trigger guard to slide past the retention wedge, forcing the retention plate away from the retention bracket, disengaging the retention plate until the trigger guard has slipped past the retention wedge, allowing the retention plate to return by force of the actuator spring to a secure position, whereby the trigger guard is again positioned between the retention wedge and retention pin, thus restraining the handgun in the holster.

17. A method according to claim 16 wherein, in step (d), when the gun is secured in the holster, the gun barrel pushes a stabilizer spring cap down until it stops against a shoulder of a stabilizer pin, compressing a power spring, the stabilizer spring cap being supported on the power spring, the power spring substantially surrounding the stabilizer pin, the stabilizer pin extending in an upward direction from a bottom panel of the holster.

18. A method according to claim 17, wherein, when the actuator is depressed, and the retention wedge and the retention pin are disengaged, the power spring is released and pushes the stabilizer spring cap upward, forcing the gun upward and out of the holster.

19. A method according to claim 15, wherein, when the retention wedge and the retention pin are engaged, the gun is locked down by the retention plate and a stabilizer pin extending upward from a bottom panel of the holster.

20. A method according to claim 15, wherein, when the safety button is in the down position, the safety lock arm hook will prevent the actuator arm from moving toward the retention assembly and will thus prevent the user from releasing release of the gun.

21. A method according to claim 15, wherein, in step (a), when the safety button is moved upward, a safety detent ball is pushed into a lower, on ball slide position socket, which creates an audible click.

22. A method according to claim 11, wherein, when the safety button is in the down position, the safety lock arm hook will prevent the actuator arm from moving toward the retention assembly and will thus prevent release of the gun.

23. A method according to claim 15, wherein, in step (a), when the safety button is moved downward, a safety detent ball is pushed into an upper, off ball slide position socket, which creates an audible click.

* * * * *